US009222155B2

(12) United States Patent
Nakamura et al.

(10) Patent No.: US 9,222,155 B2
(45) Date of Patent: Dec. 29, 2015

(54) METHOD FOR MANUFACTURING HIGH STRENGTH HOT-ROLLED STEEL SHEET HAVING EXCELLENT STRETCH FLANGEABILITY AND FATIGUE RESISTANCE

(75) Inventors: Nobuyuki Nakamura, Tokyo (JP); Hayato Saito, Tokyo (JP); Katsumi Nakajima, Tokyo (JP); Yoshimasa Funakawa, Tokyo (JP); Noriaki Moriyasu, Tokyo (JP); Takayuki Murata, Tokyo (JP)

(73) Assignee: JFE Steel Corporation (JP)

( * ) Notice: Subject to any disclaimer, the term of this patent is extended or adjusted under 35 U.S.C. 154(b) by 311 days.

(21) Appl. No.: 13/699,028

(22) PCT Filed: May 30, 2011

(86) PCT No.: PCT/JP2011/062857

§ 371 (c)(1),
(2), (4) Date: Nov. 20, 2012

(87) PCT Pub. No.: WO2011/152541

PCT Pub. Date: Dec. 8, 2011

(65) Prior Publication Data

US 2013/0061989 A1 Mar. 14, 2013

(30) Foreign Application Priority Data

May 31, 2010 (JP) ..... 2010-125080
May 24, 2011 (JP) ..... 2011-115595

(51) Int. Cl.

| | |
|---|---|
| ***C22C 38/02*** | (2006.01) |
| ***C21D 9/46*** | (2006.01) |
| ***C22C 38/28*** | (2006.01) |
| ***C22C 38/06*** | (2006.01) |
| ***C21D 8/02*** | (2006.01) |
| ***C22C 38/14*** | (2006.01) |
| ***C21D 8/04*** | (2006.01) |
| ***C22C 38/00*** | (2006.01) |
| ***C22C 38/58*** | (2006.01) |
| ***C22C 38/12*** | (2006.01) |
| ***C22C 38/16*** | (2006.01) |
| ***C22C 38/60*** | (2006.01) |

(52) U.S. Cl.

CPC ..... *C22C 38/14* (2013.01); *C21D 8/0226* (2013.01); *C21D 8/0463* (2013.01); *C21D 9/46* (2013.01); *C22C 38/001* (2013.01); *C22C 38/005* (2013.01); *C22C 38/02* (2013.01); *C22C 38/06* (2013.01); *C22C 38/12* (2013.01); *C22C 38/16* (2013.01); *C22C 38/28* (2013.01); *C22C 38/58* (2013.01); *C22C 38/60* (2013.01); *C21D 2211/002* (2013.01); *C21D 2211/004* (2013.01)

(58) Field of Classification Search

None

See application file for complete search history.

(56) References Cited

U.S. PATENT DOCUMENTS 6,364,968 B1 4/2002 Yasuhara et al. ..... 148/320

FOREIGN PATENT DOCUMENTS

| | | | |
|---|---|---|---|
| CN | 100360698 | | 1/2008 |
| EP | 1 616 970 | | 1/2006 |
| EP | 1 790 737 | | 5/2007 |
| EP | 2 014 781 | | 1/2009 |
| JP | 4-329848 | A | 11/1992 |
| JP | 2000-109951 | A | 4/2000 |
| JP | 2000-282175 | A | 10/2000 |
| JP | 2003-129175 | A | 5/2003 |
| JP | 2005-206943 | A | 8/2005 |
| JP | 2006-161139 | A | 6/2006 |
| JP | 2006-274318 | A | 10/2006 |
| JP | 2007-111708 | A | 5/2007 |
| JP | 2008-069425 | A | 3/2008 |
| JP | 2009-280900 | A | 12/2009 |

OTHER PUBLICATIONS

Machine-English translation of Japanese patent No. 2009-280900, Yokota Takeshi et al., Dec. 3, 2009.*

Supplementary European Search Report dated Feb. 28, 2014 from corresponding European Application No. EP 11 78 9942.

* cited by examiner

*Primary Examiner* — Deborah Yee

(74) *Attorney, Agent, or Firm* — DLA Piper LLP (US)

(57) ABSTRACT

A high strength hot-rolled steel sheet has a tensile strength of not less than 780 MPa and exhibits excellent stretch flangeability and excellent fatigue resistance. A steel has a composition containing C at 0.05 to 0.15%, Si at 0.2 to 1.2%, Mn at 1.0 to 2.0%, P at not more than 0.04%, S at not more than 0.005%, Ti at 0.05 to 0.15%, Al at 0.005 to 0.10% and N at not more than 0.007%.

5 Claims, No Drawings

METHOD FOR MANUFACTURING HIGH STRENGTH HOT-ROLLED STEEL SHEET HAVING EXCELLENT STRETCH FLANGEABILITY AND FATIGUE RESISTANCE

RELATED APPLICATIONS

This is a §371 of International Application No. PCT/JP2011/062857, with an international filing date of May 30, 2011 (WO 2011/152541 A1, published Dec. 8, 2011), which is based on Japanese Patent Application Nos. 2010-125080, filed May 31, 2010, and 2011-115595, filed May 24, 2011, the subject matter of which is incorporated herein by reference.

TECHNICAL FIELD

This disclosure relates to a high strength hot-rolled steel sheet suitable for parts such as automobile structural parts and frames for trucks, particularly to improvements in stretch flangeability and fatigue resistance.

BACKGROUND

Improving the fuel efficiency of automobiles has recently become an important issue from the viewpoint of global environment conservation. Active efforts have been made to reduce the weight of car bodies themselves by increasing the strength of materials used and reducing the thickness of members. While various kinds of hot-rolled steel sheets heretofore used for automobile parts have a grade in terms of tensile strength of 440 MPa or 540 MPa, there has recently been an increasing need for high strength hot-rolled steel sheets having a grade of 780 MPa or higher. On the other hand, increasing the strength of steel sheets is generally accompanied by a decrease in formability. Thus, various studies have been carried out with regard to improvements in stretch flangeability (or hole expandability) required for steel sheets to be used as automobile parts.

For example, Japanese Unexamined Patent Application Publication No. 2006-274318 describes a method for manufacturing high strength hot-rolled steel sheets which includes hot rolling a steel slab containing C at 0.05 to 0.15%, Si at not more than 1.50%, Mn at 0.5 to 2.5%, P at not more than 0.035%, S at not more than 0.01%, Al at 0.02 to 0.15% and Ti at 0.05 to 0.2% at a finishing temperature of not less than the $A_{r3}$ transformation point, thereafter cooling the steel sheet to the temperature range of 400 to 550° C. at a cooling rate of not less than 30° C./s followed by coiling, and cooling the coiled coil to not more than 300° C. at an average cooling rate of 50 to 400° C./h, thereby manufacturing a hot-rolled steel sheet which has a microstructure containing bainite at 60 to 95% by volume as well as ferrite or ferrite and martensite. The technique of JP '318 is described as being capable of manufacturing high strength hot-rolled steel sheets with excellent hole expansion workability which have a sheet thickness of about 2 mm and exhibit a tensile strength of not less than 780 MPa and a hole expanding ratio of not less than 60%.

Further, Japanese Unexamined Patent Application Publication No. 4-329848 describes a high strength hot-rolled steel sheet which has a composition containing C at 0.03 to 0.25%, Si at not more than 2.0%, Mn at not more than 2.0%, P at not more than 0.1%, S at not more than 0.007%, Al at not more than 0.07% and Cr at not more than 1.0% and satisfying {(Si+20P)/(Mn+Cr)}=0.6 to 1.5, and is formed of ferrite and a second phase wherein the hardness of the second phase Hv is 200 to 600, the volume fraction of the second phase is 5 to 40%, the grain diameter of the second phase is not more than 25 μm, and a specific relationship is satisfied by the sum of the product of the hardness and the volume fraction of ferrite plus the product of the hardness and the volume fraction of the second phase. It is described that the technique of JP '848 can produce high strength hot-rolled steel sheets with excellent fatigue strength and stretch flangeability which exhibit a strength exceeding 490 MPa.

Japanese Unexamined Patent Application Publication No. 2009-280900 describes a method for manufacturing high strength hot-rolled steel sheets having a tensile strength of not less than 780 MPa which includes hot rolling a steel slab containing C at 0.04 to 0.15%, Si at 0.05 to 1.5%, Mn at 0.5 to 2.0%, P at not more than 0.06%, S at not more than 0.005%, Al at not more than 0.10% and Ti at 0.05 to 0.20% at a finishing temperature of 800 to 1000° C., thereafter cooling the steel sheet at a cooling rate of not less than 55° C./s and subsequently at a cooling rate of not less than 120° C./s for the temperature range of not more than 500° C. so as to cool the steel sheet by nucleate boiling cooling, and coiling the steel sheet at 350 to 500° C. It is described that according to the technique of JP '900, a high strength hot-rolled steel sheet with a tensile strength of not less than 780 MPa is obtained which has a microstructure containing more than 95% of bainite and less than 5% of inevitable other phases and exhibits excellent stretch flangeability after working as well as stably small variations in quality inside the steel sheet.

Further, Japanese Unexamined Patent Application Publication No. 2000-109951 describes a method for manufacturing high strength hot-rolled steel sheets having excellent stretch flangeability which includes heating a steel slab containing C at 0.05 to 0.30%, Si at not more than 1.0%, Mn at 1.5 to 3.5%, P at not more than 0.02%, S at not more than 0.005%, Al at not more than 0.150% and N at not more than 0.0200% and further containing one or two of Nb at 0.003 to 0.20% and Ti at 0.005 to 0.20% to a temperature of not more than 1200° C., hot rolling the steel slab at a finish roll-starting temperature of 950 to 1050° C. and a finish roll-finishing temperature of not less than 800° C., initiating cooling within 2 seconds after the completion of the rolling and continuously cooling the steel sheet to a coiling temperature at an average cooling rate of 20 to 150° C./s, and coiling the steel sheet at 300 to 550° C. A hot-rolled steel sheet manufactured by the technique of JP '951 is described to exhibit high strength with a tensile strength of not less than 780 MPa and to exhibit excellent stretch flangeability because it has a microstructure based on fine bainite having an average grain diameter of not more than 3.0 μm and is free from mixed grains or coarse grains with a grain diameter exceeding 10 μm.

Japanese Unexamined Patent Application Publication No. 2000-282175 describes a method for manufacturing ultrahigh strength hot-rolled steel sheets having excellent workability which includes casting a steel slab containing C at 0.05 to 0.20%, Si at 0.05 to 0.50%, Mn at 1.0 to 3.5%, P at not more than 0.05%, S at not more than 0.01%, Nb at 0.005 to 0.30%, Ti at 0.001 to 0.100%, Cr at 0.01 to 1.0% and Al at not more than 0.1% and satisfying 0.05≤(% Si+% P)/(% Cr+% Ti+% Nb+% Mn)≤0.5, immediately thereafter or after once cooling the steel slab heating the steel slab to 1100 to 1300° C. and hot rolling it at a finish roll-finishing temperature of 950 to 800° C., initiating cooling within 0.5 seconds after the completion of the rolling and cooling the steel sheet at a cooling rate of not less than 30° C./s, and coiling the steel sheet at 500 to 300° C. A hot-rolled steel sheet manufactured by the technique of JP '175 is described to exhibit high strength with a tensile strength of not less than 980 MPa and to have a microstructure which includes bainite as a main phase at a volume fraction of not less than 60% and less than 90% and at least one of pearlite, ferrite, retained austenite and martensite as a second phase and in which the bainite phase has an average grain diameter of less than 4 μm. The steel sheet is also described to exhibit excellent workability.

According to the technique described in JP '318, stretch flangeability is improved by increasing toughness, namely by lowering the fracture appearance transition temperature by means of reducing the segregation of phosphorus in ferrite grain boundaries. However, the technique of JP '318 has a problem in that it is extremely difficult to improve stretch flangeability if the steel does not contain ferrite or the ferrite content is extremely low. Further, the technique described in JP '848 has a problem in that because the fraction of the soft ferrite phase is 60% or more, the steel sheet cannot stably ensure high strength meeting the recent need for as high a strength as 780 MPa or more; namely, the strength of the steel sheet is insufficient. Further, while the technique described in JP '900 can ensure high strength with a tensile strength of not less than 780 MPa, the steel sheet does not still have sufficient fatigue resistance required for automobile parts because controlling of the bainite phase microstructure is insufficient.

The technique described in JP '951 provides a very fine bainite microstructure. However, because niobium and titanium remain without being dissolved during heating of the slab, sufficient amounts of dissolved titanium and niobium cannot be ensured, thus resulting in insufficient fatigue resistance in some cases. According to the technique described in JP '175, phases other than the bainite phase are present at least in excess of 10% and thus the homogenization of the microstructure is insufficient, resulting in insufficient stretch flangeability in some cases.

It could therefore be helpful to provide a high strength hot-rolled steel sheet having high strength with a tensile strength of not less than 780 MPa as well as exhibiting excellent stretch flangeability and excellent fatigue resistance.

SUMMARY

We discovered that stretch flangeability as well as fatigue resistance are markedly improved while high strength with a tensile strength of not less than 780 MPa is maintained by forming a fine bainite single phase microstructure having an average grain diameter of not more than 5 μm or a microstructure in which such a fine bainite phase as described above is the main phase and the second phase is a dispersed fine phase formed by any of pearlite, martensite, retained austenite and a mixture thereof with an average grain diameter of not more than 3 μm, as well as by causing dissolved titanium to remain at a content of not less than 0.02%.

Until now, the mechanism whereby a fine bainite phase and dissolved titanium provide improvements in stretch flangeability as well as fatigue resistance was not fully clear. However, we believe the mechanism to be as follows:

The presence of at least a prescribed amount of dissolved titanium probably suppresses the progression of cracks through the formation of TiC or Ti and C clusters which is easily induced by stress or deformation in a stress- or deformation-concentrated region at a tip of a crack generated during stretch flange formation or a tip of a fatigue crack. Marked improvements in terms of stretch flangeability as well as fatigue resistance are probably ascribed to this assumed mechanism.

We thus provide:

(1) A high strength hot-rolled steel sheet with excellent stretch flangeability and fatigue resistance which has a composition containing, in terms of mass %, C at 0.05 to 0.15%, Si at 0.2 to 1.2%, Mn at 1.0 to 2.0%, P at not more than 0.04%, S at not more than 0.005%, Ti at 0.05 to 0.15%, Al at 0.005 to 0.10% and N at not more than 0.007%, the content of dissolved Ti being not less than 0.02%, the balance being represented by Fe and inevitable impurities, and includes a bainite single phase microstructure having an average grain diameter of not more than 5 μm.

(2) The high strength hot-rolled steel sheet described in (1), wherein instead of the average grain diameter being not more than 5 μm, the average grain diameter is more than 3.0 to 5 μm.

(3) The high strength hot-rolled steel sheet described in (1), wherein instead of the bainite single phase microstructure, the steel sheet has a microstructure which includes a bainite phase at an area ratio of not less than 90% relative to the entirety of the microstructure and a second phase other than the bainite phase and in which the average grain diameter of the bainite phase is not more than 5 μm and the average grain diameter of the second phase is not more than 3 μm.

(4) The high strength hot-rolled steel sheet described in (3), wherein instead of the average grain diameter of the bainite phase being not more than 5 μm, the average grain diameter of the bainite phase is more than 3.0 to 5 μm.

(5) The high strength hot-rolled steel sheet described in any one of (1) to (4), wherein the composition further contains, in terms of mass %, Sb at 0.001 to 0.020%.

(6) The high strength hot-rolled steel sheet described in any one of (1) to (5), wherein the composition further contains, in terms of mass %, one, or two or more selected from Cu at 0.05 to 0.20%, Ni at 0.05 to 0.50%, Mo at 0.05 to 0.50%, Cr at 0.05 to 0.50%, B at 0.0005 to 0.0050%, Nb at 0.01 to 0.10% and V at 0.01 to 0.20%.

(7) The high strength hot-rolled steel sheet described in any one of (1) to (6), wherein the composition further contains, in terms of mass %, one or two selected from Ca at 0.0001 to 0.0050% and REM at 0.0005 to 0.0100%.

(8) A method for manufacturing high strength hot-rolled steel sheets with excellent stretch flangeability and fatigue resistance, including hot rolling a steel which has a composition containing, in terms of mass %, C at 0.05 to 0.15%, Si at 0.2 to 1.2%, Mn at 1.0 to 2.0%, P at not more than 0.04%, S at not more than 0.005%, Ti at 0.05 to 0.15%, Al at 0.005 to 0.10% and N at not more than 0.007%, the balance being represented by Fe and inevitable impurities, into a hot-rolled sheet in such a manner that the steel is heated to 1150 to 1350° C. and is thereafter hot rolled by hot rolling which is terminated at a finishing temperature of 850 to 950° C., after the completion of the hot rolling cooling the steel sheet to 530° C. at an average cooling rate of not less than 30° C./s, subsequently cooling the steel sheet to a coiling temperature of 300 to 500° C. at an average cooling rate of not less than 100° C./s, and coiling the steel sheet at the coiling temperature.

(9) The method for manufacturing high strength hot-rolled steel sheets described in (8), wherein instead of the hot rolling performed in such a manner that the steel is heated to 1150 to 1350° C. and is thereafter hot rolled by hot rolling which is terminated at a finishing temperature of 850 to 950° C., the method includes hot rolling in such a manner that the steel is heated to more than 1200° C. to not more than 1350° C. and is thereafter hot rolled by hot rolling which is terminated at a finishing temperature of more than 900° C. to not more than 950° C.

(10) The method for manufacturing high strength hot-rolled steel sheets described in (8) or (9), wherein the composition further contains, in terms of mass %, Sb at 0.001 to 0.020%.

(11) The method for manufacturing high strength hot-rolled steel sheets described in any one of (8) to (10), wherein the composition further contains, in terms of mass %, one, or two or more selected from Cu at 0.05 to 0.20%, Ni at 0.05 to 0.50%, Mo at 0.05 to 0.50%, Cr at 0.05 to 0.50%, B at 0.0005 to 0.0050%, Nb at 0.01 to 0.10% and V at 0.01 to 0.20%.

(12) The method for manufacturing high strength hot-rolled steel sheets described in any one of (8) to (11), wherein the composition further contains, in terms of mass %, one or two selected from Ca at 0.0001 to 0.0050% and REM at 0.0005 to 0.0100%.

Our steel sheets and methods allow for easy manufacturing of hot-rolled steel sheets exhibiting improved stretch flangeability and fatigue resistance while maintaining high strength with a tensile strength of not less than 780 MPa, thus achieving marked industrial advantageous effects. Further, the high strength hot-rolled steel sheet is advantageous in that the use thereof for such parts as automobile structural parts or frames for trucks can reduce the weight of car bodies while ensuring safety, thus reducing the effects on the environment.

DETAILED DESCRIPTION

First, the reasons why the composition steel sheet is limited will be described. Hereinbelow, mass % will be simply referred to as % unless otherwise mentioned.

C: 0.05 to 0.15%

Carbon is an element that increases the strength of steel, promotes the formation of bainite, and contributes to precipitation strengthening by combining with titanium to form titanium carbide. The C content needs to be not less than 0.05% to obtain these effects. On the other hand, weldability is lowered if the content exceeds 0.15%. Thus, the C content is limited to 0.05 to 0.15%. The content is preferably 0.07 to 0.12%.

Si: 0.2 to 1.2%

Silicon is an element that contributes to increasing the strength of steel by being dissolved in the steel. The Si content needs to be not less than 0.2% to obtain this effect. On the other hand, any content in excess of 1.2% results in a marked deterioration of surface properties of steel sheets, thus leading to decreases in chemical conversion properties and corrosion resistance. Thus, the Si content is limited to 0.2 to 1.2%. The content is preferably 0.3 to 0.9%.

Mn: 1.0 to 2.0%

Manganese is an element that increases the strength of steel by being dissolved in the steel and promotes the formation of bainite through the improvement of hardenability. The Mn content needs to be not less than 1.0% to obtain these effects. On the other hand, any content in excess of 2.0% promotes center segregation and lowers the formability of steel sheets. Thus, the Mn content is limited to 1.0 to 2.0%. The content is preferably 1.2 to 1.8%.

P: not more than 0.04%

Phosphorus has an effect of increasing the strength of steel by being dissolved in the steel. However, this element is segregated in grain boundaries, in particular prior austenite grain boundaries, thus causing deteriorations in low-temperature toughness and workability. Thus, it is desirable that the P content be reduced as much as possible. However, a content of not more than 0.04% is acceptable. The content is preferably not more than 0.03%.

S: not more than 0.005%

Sulfur combines with manganese and titanium to form sulfides and lowers the workability of steel sheets. Thus, it is desirable that the S content be reduced as much as possible. However, a content of not more than 0.005% is acceptable. The content is preferably not more than 0.003%, and more preferably not more than 0.001%.

Ti: 0.05 to 0.15%, dissolved Ti: not less than 0.02%

Titanium is an element that forms a carbide contributing to increasing the strength of steel by precipitation strengthening. Further, titanium also contributes to the size reduction of austenite grains which leads to a fine microstructure of the finally obtainable steel sheet, as well as contributes to improvements of stretch flangeability and fatigue resistance. The Ti content needs to be not less than 0.05% to obtain these effects. On the other hand, excessive addition of titanium in excess of 0.15% is encountered with a saturation of the above effects, causes an increase of coarse precipitates, and results in deteriorations in hole expansion workability and fatigue resistance. Thus, the Ti content is limited to 0.05 to 0.15%. The content is preferably 0.06 to 0.12%.

Part of the titanium added is caused to be present as dissolved titanium at a content of not less than 0.02%, whereby further improvements in terms of stretch flangeability and fatigue resistance can be expected. It is considered that the presence of at least this prescribed amount of dissolved titanium suppresses the progression of cracks through formation of TiC or Ti and C clusters which is easily induced by stress or deformation in a stress- or deformation-concentrated region at a tip of a crack generated during stretch flange formation or a tip of a fatigue crack.

To stably ensure a dissolved Ti content of not less than 0.02%, it is preferable that, in addition to adding titanium at a content of not less than 0.05%, this content be controlled such that the relationship of the content with the C content, namely, (Ti/48)/(C/12), becomes not less than 0.15. Ti and C represent the respective contents (mass %). If C is largely in excess over Ti and (Ti/48)/(C/12) becomes less than 0.15, titanium is easily precipitated as TiC to make it difficult to ensure the presence of dissolved titanium. Thus, it is preferable that (Ti/48)/(C/12) be not less than 0.15. If C is excessively smaller than Ti and (Ti/48)/(C/12) exceeds 0.60, ensuring dissolved titanium is facilitated but the amount of dissolved carbon is decreased so as to lower the strength of the bainite phase, thus making it difficult to ensure a desired strength. Thus, the ratio is more preferably 0.15 to 0.60, and (Ti/48)/(C/12) is still more preferably 0.18 to 0.35.

If the dissolved Ti content is less than 0.02%, a decrease is caused in the effect of suppressing the progression of a working crack or a fatigue crack. Thus, desired improvements in terms of stretch flangeability and fatigue resistance cannot be expected. If dissolved titanium is present in a large amount exceeding 0.10%, hardenability is so increased that a martensite phase is easily formed, thereby resulting in lower workability. Thus, it is preferable that the dissolved Ti content be not more than 0.10%.

Al: 0.005 to 0.10%

Aluminum is an element that works as a deoxidizer and is effective to increase the cleanliness of steel. The Al content needs to be not less than 0.005% to obtain these effects. On the other hand, adding aluminum in an excessively large amount exceeding 0.10% causes a marked increase in the amounts of oxide inclusions and causes the generation of defects in steel sheets. Thus, the Al content is limited to 0.005 to 0.10%. The content is preferably 0.03 to 0.07%.

N: not more than 0.007%

Nitrogen combines with nitride-forming elements such as Ti and is precipitated as nitrides. In particular, this element easily combines with titanium at a high temperature to form a coarse nitride which tends to serve as a starting point of a crack during stretch flange formation or a fatigue test. Thus, it is desirable that the N content be reduced as much as possible. Therefore, the N content is limited to be not more than 0.007%. The content is preferably not more than 0.005%, and more preferably not more than 0.003%.

The components described above are basic components. In addition to these basic components, the steel sheet may contain optional elements as desired which is Sb at 0.001 to 0.020%, and/or one, or two or more selected from Cu at 0.05 to 0.20%, Ni at 0.05 to 0.50%, Mo at 0.05 to 0.50%, Cr at 0.05 to 0.50%, B at 0.0005 to 0.0050%, Nb at 0.01 to 0.10% and V at 0.01 to 0.20%, and/or one or two selected from Ca at 0.0001 to 0.0050% and REM at 0.0005 to 0.0100%.

Sb: 0.001 to 0.020%

Antimony is an element that tends to be concentrated in a superficial layer during heating for hot rolling, and suppresses formation of oxides of elements such as Si and Mn near the surface to improve surface properties of steel sheets and also suppresses occurrence of fatigue cracks starting from the surface to contribute to an improvement in fatigue resistance. The Sb content needs to be not less than 0.001% to obtain these effects. In excess of 0.020%, however, the effects are saturated and economic disadvantages are caused. Thus, when antimony is added, the Sb content is preferably limited to 0.001 to 0.020%. The content is more preferably 0.003 to 0.010%.

One, or two or more selected from Cu: 0.05 to 0.20%, Ni: 0.05 to 0.50%, Mo: 0.05 to 0.50%, Cr: 0.05 to 0.50%, B: 0.0005 to 0.0050%, Nb: 0.01 to 0.10% and V: 0.01 to 0.20%

Copper, nickel, molybdenum, chromium, boron, niobium and vanadium are each an element that contributes to increasing the strength of steel sheets, and may be selected and added in accordance with need.

Copper increases the strength of steel by being dissolved in the steel and facilitates formation of a bainite phase through improvement of hardenability. The Cu content is preferably not less than 0.05% to obtain these effects. If the content exceeds 0.20%, however, surface properties are lowered. Thus, when copper is added, the Cu content is preferably limited to 0.05 to 0.20%.

Nickel increases the strength of steel by being dissolved in the steel and facilitates formation of a bainite phase through improvement of hardenability. The Ni content is preferably not less than 0.05% to obtain these effects. If the content exceeds 0.50%, however, a martensite phase is easily formed and workability is lowered. Thus, when nickel is added, the Ni content is preferably limited to 0.05 to 0.50%.

Molybdenum increases the strength of steel through precipitation strengthening by formation of a carbide as well as through improvement of hardenability. In addition, this element facilitates formation of a bainite phase and improves stretch flangeability and fatigue resistance. The Mo content is preferably not less than 0.05% to obtain these effects. If the content exceeds 0.50%, however, a martensite phase is easily formed and workability is lowered. Thus, when molybdenum is added, the Mo content is preferably limited to 0.05 to 0.50%.

Chromium increases the strength of steel through improvement of hardenability and facilitates formation of a bainite phase to improve stretch flangeability and fatigue resistance. The Cr content is preferably not less than 0.05% to obtain these effects. If the content exceeds 0.50%, however, a martensite phase is easily formed and workability is lowered. Thus, when chromium is added, the Cr content is preferably limited to 0.05 to 0.50%.

Boron is an element segregated in austenite (γ) grain boundaries to suppress formation and growth of ferrite at and from the grain boundaries, and contributes to increasing the strength of steel through improvement of hardenability. The B content is preferably not less than 0.0005% to obtain these effects. If the content exceeds 0.0050%, however, workability is lowered. Thus, when boron is added, the B content is preferably limited to 0.0005 to 0.0050%.

Niobium is an element that contributes to increasing the strength of steel by forming a carbide and a nitride. The Nb content is preferably not less than 0.01% to obtain this effect. If the content exceeds 0.10%, however, ductility and hole expansion workability are lowered. Thus, when niobium is added, the Nb content is preferably limited to 0.01 to 0.10%.

Vanadium is an element that contributes to increasing the strength of steel by forming a carbide and a nitride. The V content is preferably not less than 0.01% to obtain this effect. If the content exceeds 0.20%, however, ductility and hole expansion workability are lowered. Thus, when vanadium is added, the V content is preferably limited to 0.01 to 0.20%.

One or two selected from Ca: 0.0001 to 0.0050% and REM: 0.0005 to 0.0100%

Calcium and a rare earth metal, which may be added as desired, are elements that have effects of controlling the morphology of sulfides to a spherical shape and improving stretch flangeability. It is preferable that the steel sheet contain Ca and REM at not less than 0.0001% and not less than 0.0005%, respectively, to obtain these effects. However, adding these elements at contents exceeding 0.0050% for Ca and 0.0100% for REM causes an increase in the amounts of inclusions and the like and increases the probability of the frequent occurrence of surface defects and internal defects. Thus, when these elements are added, the Ca content and the REM content are preferably limited to 0.0001 to 0.0050%, and 0.0005 to 0.0100%, respectively.

The balance after the deduction of the aforementioned components is represented by Fe and inevitable impurities.

Next, the reasons why the microstructure of the steel sheet is limited will be described.

The microstructure of the steel sheet is a fine bainite single phase microstructure. Alternatively, instead of the bainite single phase microstructure, the microstructure is preferably a microstructure formed of a main phase and a fine second phase in which the main phase is a fine bainite phase having an area ratio of not less than 90% relative to the entirety of the microstructure. The fine bainite phase refers to a bainite phase having an average grain diameter of not more than 5 μm. Preferably, the average grain diameter of the bainite phase is more than 3.0 μm and not more than 5 μm. This configuration allows the hot-rolled steel sheet to exhibit high strength with a tensile strength of not less than 780 MPa as well as excellent stretch flangeability and fatigue resistance.

In the case where the microstructure is formed of the main phase and the second phase, any area ratio of the fine bainite main phase being less than 90% makes it impossible to stably ensure desired high strength and good stretch flangeability. Further, if the average grain diameter of the bainite phase exceeds 5 μm, the steel sheet cannot exhibit excellent stretch flangeability and excellent fatigue resistance at the same time. For these reasons, the area ratio and the average grain diameter of the fine bainite phase that is the main phase are limited to be not less than 90% and not more than 5 μm. Preferably, the average grain diameter of the bainite phase is more than 3.0 μm and not more than 5 μm. By controlling the average grain diameter of the bainite phase to be more than 3.0 μm and not more than 5 μm, a fatigue crack comes to progress taking a longer detour than when the average grain diameter is 3.0 μm or less. As a result, the speed of the progression of a fatigue crack becomes slow and fatigue resistance is further improved. Preferably, the bainite phase represents not less than 95%, and more preferably the microstructure is a bainite single phase.

As the second phase other than the main phase, the microstructure may contain any of martensite, pearlite and retained austenite or a mixture of these phases. The second phase is a fine phase having an average grain diameter of not more than 3 μm. If the average grain diameter of the second phase exceeds 3 μm, a crack easily occurs from a boundary between the main phase and the second phase, thus resulting in decreases in stretch flangeability and fatigue resistance. Thus, the average grain diameter of the second phase is limited to be not more than 3 μm. Preferably, the average grain diameter of the second phase is not more than 2 μm. The fine second phase has an area ratio of not more than 10% relative to the entirety of the microstructure. It is more preferable that the area ratio be limited to not more than 5% to further improve stretch flangeability.

Preferably, the second phase is any of martensite, pearlite and retained austenite or a mixture of these phases. In addition to these phases, however, ferrite and cementite may be present in the second phase as long as the area ratio relative to the entirety of the microstructure is not more than 3%. In such a case too, the second phase is a fine phase with an average grain diameter of not more than 3 μm due to the aforementioned reasons.

Next, a preferred method for manufacturing the steel sheets will be described.

A steel having the aforementioned composition except the dissolved Ti content is used as a starting material.

The steel may be manufactured by any method without limitation. Any common method may be adopted in which a molten steel having the above composition is smelted in a furnace such as a converter furnace or an electric furnace, preferably subjected to secondary smelting in a vacuum degassing furnace, and cast into a steel such as a slab by a casting method such as continuous casting.

First, the steel is hot rolled into a hot-rolled sheet. After the completion of hot rolling, the steel sheet is cooled to 530° C. by precedent cooling and then cooled from 530° C. to a coiling temperature by subsequent cooling, and is thereafter coiled into a coil.

The heating temperature for hot rolling is 1150 to 1350° C.

In the steel (the slab), most carbide- and nitride-forming elements such as titanium are present as coarse carbides and nitrides. To utilize these elements as dissolved titanium and fine precipitates to, for example, increase the strength of the hot-rolled steel sheet, these coarse carbides and nitrides need to be once dissolved. Thus, the steel is first heated to 1150° C. or above. On the other hand, increasing the heating temperature above 1350° C. generates a large amount of scales. As a result, the surface quality is deteriorated by, for example, scale defects. Thus, the heating temperature for the steel is limited to 1150 to 1350° C. The heating temperature is preferably 1200 to 1300° C. The heating temperature for the steel is more preferably in excess of 1200° C. to reliably ensure the dissolved Ti content.

In the hot rolling, the steel is rolled by hot rolling which is terminated at a finishing temperature of 850 to 950° C.

If the finishing temperature is less than 850° C., rolling takes place while the temperature is in a two-phase, namely, ferrite+austenite region, thus leaving worked microstructures and lowering stretch flangeability and fatigue resistance. If the finishing temperature is above 950° C., austenite grains are grown with the result that the microstructure of the hot-rolled sheet obtained after cooling becomes coarse. Thus, the finishing temperature is limited to 850 to 950° C. The finishing temperature is preferably 880 to 930° C. By increasing the finishing temperature above 900° C., the growth of austenite grains becomes marked, hardenability is increased, the fraction of the bainite phase in the microstructure is increased, and the microstructure becomes further homogeneous, thereby achieving a further improvement in stretch flangeability. Further, this facilitates controlling the average grain diameter of bainite to be more than 3.0 μm and not more than 5 μm and increases fatigue resistance. For these reasons, it is more preferable that the finishing temperature be more than 900° C. and not more than 950° C.

After completion of hot rolling, the steel sheet is cooled to 530° C. by precedent cooling at an average cooling rate of not less than 30° C./s.

Cooling from the temperature at the completion of hot rolling to 530° C. is very important to ensure a desired fine bainite microstructure. If cooling to 530° C. is performed at an average cooling rate of less than 30° C./s, formation of ferrite progresses to a marked extent, pearlite is formed, and precipitation of TiC becomes marked to make it impossible to ensure a desired dissolved Ti content, thus resulting in decreases in stretch flangeability and fatigue resistance. Thus, the average cooling rate for cooling from the temperature at the completion of hot rolling to 530° C. is limited to be not less than 30° C./s. If cooling to 530° C. is performed at an average cooling rate of 55° C./s or more, transformation from unrecrystallized austenite occurs frequently and the amounts of ferrite and bainite extending in the rolling direction are increased with the result that workability is easily lowered. Thus, the average cooling rate in this temperature range is preferably less than 55° C./s.

The hot-rolled sheet cooled to 530° C. is thereafter rapidly cooled from 530° C. to a coiling temperature by subsequent cooling at an average cooling rate of not less than 100° C./s. Bainite transformation is performed during this subsequent cooling (rapid cooling) to form a fine bainite phase as well as to control the average grain diameter of the fine bainite phase to be not more than 5 μm. Having such a fine bainite single phase is preferable for the steel sheet to exhibit excellent stretch flangeability and excellent fatigue resistance. Even if the microstructure cannot be formed of a bainite single phase, cooling at the above average cooling rate ensures that such a fine bainite phase as described above forms the main phase and the second phase is a fine second phase having an average grain diameter of not more than 3 μm. Thus, cooling from 530° C. to a coiling temperature is specified to be rapid cooling at an average cooling rate of not less than 100° C./s. In this manner, it is possible to suppress decreases in terms of stretch flangeability and fatigue resistance due to formation of the second phase. On the other hand, controlling the cooling rate becomes difficult if the average cooling rate in the subsequent cooling from 530° C. to a coiling temperature exceeds 180° C./s. Thus, the average cooling rate in the subsequent cooling is preferably limited to be 100 to 180° C./s. The average cooling rate is more preferably not less than 120° C./s.

The coiling temperature is 300 to 500° C.

If the coiling temperature is less than 300° C., martensite and retained austenite are formed in such large amounts that it becomes difficult for the fine bainite phase to represent 100% (single phase) or not less than 90% in terms of area ratio. As a result, the desired microstructure cannot be ensured, and stretch flangeability and fatigue resistance are lowered. If the coiling temperature is in excess of 500° C., the amount of pearlite is increased with the result that stretch flangeability and fatigue resistance are markedly lowered. Thus, the coiling temperature is limited to 300 to 500° C. From the viewpoint of the size reduction of the bainite phase, the coiling temperature is preferably not less than 350° C. and not more than 450° C.

After being coiled, the hot-rolled sheet may be subjected to pickling according to a common method to remove scales. Further, the steel sheet may be temper rolled, or may be further subjected to hot dip galvanization, electrogalvanization or chemical conversion treatment.

Hereinbelow, our steel sheets and methods will be further described with respect to examples.

EXAMPLES

Steels having compositions shown in Table 1 were smelted in a converter furnace and continuously cast into slabs (steel materials). Thereafter, these steel materials were heated under conditions described in Table 2 and hot rolled by rolling which was terminated at a finishing temperature shown in Table 2, thereby preparing hot-rolled sheets (sheet thickness: 6.0 to 2.6 mm). After completion of hot rolling, these hot-rolled sheets were subjected to precedent cooling and subsequent cooling under conditions shown in Table 2, and were coiled at a coiling temperature shown in Table 2. The precedent cooling after the completion of hot rolling lowered the temperature from the finishing temperature to 530° C. The subsequent cooling lowered the temperature from 530° C. to the coiling temperature. In the table, the cooling rates are average cooling rates for the respective cooling temperature ranges.

The obtained hot-rolled sheets were pickled. Thereafter, test pieces were sampled and subjected to a microstructure observation, a measurement of the dissolved Ti content, a microstructure observation, a tensile test, a hole expandability test and a fatigue test. With respect to steel sheet No. 2 (sheet thickness: 6.0 mm), test pieces were sampled from the obtained hot-rolled sheet without performing pickling. The test methods are as follows.

(1) Microstructure Observation

A test piece for microstructure observation was sampled from the obtained hot-rolled sheet. A cross section parallel to the rolling direction was polished and was etched with an etching liquid (a 3% Nital liquid) to expose the microstructure. A portion that was found at ¼ of the sheet thickness was observed using a scanning electron microscope (magnification: 3000×). Three fields of view were imaged for each. The images were processed to determine the area ratio (the fraction in the microstructure) of each phase. The same scanning electron micrographs were further processed such that two straight lines 80 mm in length were drawn at an angle of 45° relative to the direction of the sheet thickness and such that the lines were orthogonal to each other. The lengths of segments of the straight lines that crossed each of the grains of each phase were measured. The average value of the obtained lengths of the line segments was calculated as an average grain diameter of each of the phases (bainite phase, second phase).

(2) Measurement of Dissolved Ti Content

An analytical test piece (size: 50 mm×100 mm) was sampled from the obtained hot-rolled sheet. It was mechanically ground to remove a ¼ portion from the surface in the sheet thickness direction, thereby preparing an electrolytic test piece. The test piece was subjected to constant-current electrolysis at a current density of 20 mA/cm$^2$ in a 10% AA electrolytic solution (10 vol % acetylacetone-1 mass % tetramethylammonium chloride methanol) to electrolyze approximately 0.2 g. The resultant electrolysis solution was filtered and analyzed with an ICP emission spectrophotometer to determine the amount of Ti in the electrolysis solution. The obtained weight of titanium in the electrolysis solution was divided by the electrolyzed weight to determine the dissolved Ti content (mass %). The electrolyzed weight was calculated by washing the electrolyzed test piece to remove precipitates that had attached thereto, measuring the weight of the test piece, and subtracting the weight from the weight of the test piece before electrolysis.

(3) Tensile Test

A JIS No. 5 test piece (GL: 50 mm) was sampled from the obtained hot-rolled sheet such that the tensile direction would be perpendicular to the rolling direction. A tensile test was carried out in accordance with JIS Z 2241 to determine tensile properties (yield strength YS, tensile strength TS, elongation El).

(4) Hole Expandability Test (Stretch Flangeability Evaluation Test)

A test piece for testing hole expandability (size: 130×130 mm) was sampled from the obtained hot-rolled sheet. In accordance with The Japan Iron and Steel Federation Standards JFS T 1001, a 10 mm diameter punch hole was punched in the center of the test piece and a 60° conical punch was pushed up and inserted into the hole. When a crack penetrated the sheet thickness, the hole diameter d mm was measured. The hole expanding ratio λ (%) was calculated by the following equation:

$$\lambda(\%)=\{(d-10)/10\}\times 100.$$

(5) Fatigue Test

A No. 1 test piece (R: 42.5 mm, b: 20 mm) in accordance with JIS Z 2275 was sampled from the obtained hot-rolled sheet such that the longitudinal direction of the test piece was perpendicular to the rolling direction. The test piece was subjected to a plane bending fatigue test. A stress was applied by swinging both sides. The repetition number was $10^7$ times. The upper limit of the stress which the test piece endured without breakage was obtained as fatigue limit (σf). Fatigue resistance was evaluated based on the ratio of the fatigue limit to TS, of/TS.

The results are described in Table 3.

TABLE 1

| Steel No. | Chemical composition (mass %) | | | | | | | | | | | (Ti/48)/(C/12) | Remarks |
|---|---|---|---|---|---|---|---|---|---|---|---|---|---|
| | C | Si | Mn | P | S | Al | Ti | N | Sb | Cu, Ni, Nb, Mo, Cr, B | Ca, REM | | |
| A | 0.08 | 0.65 | 1.6 | 0.01 | 0.0007 | 0.03 | 0.09 | 0.003 | — | — | — | 0.28 | EX. |
| B | 0.08 | 0.65 | 1.6 | 0.01 | 0.0007 | 0.03 | 0.10 | 0.003 | 0.006 | — | — | 0.31 | EX. |
| C | 0.09 | 0.70 | 1.4 | 0.01 | 0.002 | 0.03 | 0.09 | 0.004 | — | Cu: 0.1, Ni: 0.1 | — | 0.25 | EX. |
| D | 0.10 | 0.30 | 1.2 | 0.01 | 0.0010 | 0.03 | 0.06 | 0.003 | — | Nb: 0.02 | — | 0.15 | EX. |

TABLE 1-continued

| Steel No. | Chemical composition (mass %) C | Si | Mn | P | S | Al | Ti | N | Sb | Cu, Ni, Nb, Mo, Cr, B | Ca, REM | (Ti/48)/(C/12) | Remarks |
|---|---|---|---|---|---|---|---|---|---|---|---|---|---|
| E | 0.08 | 0.80 | 1.4 | 0.01 | 0.0010 | 0.03 | 0.08 | 0.003 | — | Cr: 0.20 | — | 0.25 | EX. |
| F | 0.08 | 0.50 | 1.8 | 0.01 | 0.0010 | 0.03 | 0.11 | 0.002 | — | B: 0.0015 | — | 0.34 | EX. |
| G | 0.09 | 0.60 | 1.6 | 0.01 | 0.0010 | 0.03 | 0.08 | 0.002 | — | Mo: 0.2 | — | 0.22 | EX. |
| H | 0.05 | 1.00 | 2.0 | 0.01 | 0.0010 | 0.03 | 0.12 | 0.004 | — | — | Ca: 0.0005 | 0.60 | EX. |
| I | 0.09 | 0.50 | 1.8 | 0.01 | 0.002 | 0.03 | 0.12 | 0.004 | — | — | REM: 0.0010 | 0.33 | EX. |
| J | 0.12 | 0.80 | 1.6 | 0.01 | 0.0007 | 0.03 | 0.12 | 0.004 | 0.002 | Nb: 0.03, Mo: 0.1 | — | 0.25 | EX. |
| K | 0.12 | 0.80 | 1.6 | 0.01 | 0.0007 | 0.03 | 0.10 | 0.004 | — | Cr: 0.4, B: 0.0010 | — | 0.21 | EX. |
| L | 0.10 | 0.65 | 1.8 | 0.01 | 0.002 | 0.03 | 0.11 | 0.004 | — | Cu: 0.15, B: 0.0005 | — | 0.29 | EX. |
| M | 0.15 | 0.70 | 1.8 | 0.01 | 0.002 | 0.03 | 0.10 | 0.004 | 0.008 | Nb: 0.06 | — | 0.17 | EX. |
| N | 0.12 | 0.85 | 1.6 | 0.01 | 0.0010 | 0.03 | 0.10 | 0.004 | — | — | — | 0.21 | EX. |
| O | 0.02 | 0.60 | 1.0 | 0.01 | 0.003 | 0.03 | 0.03 | 0.004 | — | — | — | 0.38 | COMP. EX. |
| P | 0.08 | 0.70 | 2.5 | 0.01 | 0.009 | 0.03 | 0.06 | 0.004 | — | — | — | 0.19 | COMP. EX. |
| Q | 0.06 | 0.50 | 0.7 | 0.01 | 0.004 | 0.03 | 0.20 | 0.004 | — | — | — | 0.83 | COMP. EX. |
| R | 0.20 | 0.60 | 1.8 | 0.01 | 0.002 | 0.03 | 0.08 | 0.004 | — | — | — | 0.10 | COMP. EX. |
| S | 0.08 | 0.65 | 1.6 | 0.01 | 0.0007 | 0.03 | 0.09 | 0.003 | — | V: 0.01 | — | 0.28 | EX. |
| T | 0.08 | 0.65 | 1.6 | 0.01 | 0.0007 | 0.03 | 0.09 | 0.003 | — | V: 0.18 | — | 0.28 | EX. |

TABLE 2

| Steel Sheet No. | Steel No. | Hot rolling: Heating Temperature (° C.) | Hot rolling: Finish Temperature (° C.) | Cooling after hot rolling: Average cooling rate (° C./s): Precedent cooling* | Cooling after hot rolling: Average cooling rate (° C./s): Subsequent cooling** | Coiling: Coiling Temperature (° C.) | Sheet Thickness (mm) | Remarks |
|---|---|---|---|---|---|---|---|---|
| 1 | A | 1260 | 890 | 35 | 120 | 430 | 2.6 | EX. |
| 2 | A | 1260 | 910 | 35 | 120 | 430 | 2.6 | EX. |
| 3 | A | 1260 | 910 | 55 | 120 | 430 | 2.6 | EX. |
| 4 | A | 1260 | 910 | 75 | 120 | 430 | 2.6 | EX. |
| 5 | A | 1260 | 890 | 55 | 120 | 430 | 2.6 | EX. |
| 6 | A | 1260 | 900 | 30 | 110 | 430 | 6.0 | EX. |
| 7 | A | 1260 | 890 | 33 | 100 | 520 | 3.2 | COMP. EX. |
| 8 | A | 1260 | 890 | 33 | 150 | 250 | 3.2 | COMP. EX. |
| 9 | A | 1260 | 890 | 35 | 50 | 470 | 3.2 | COMP. EX. |
| 10 | A | 1260 | 890 | 20 | 115 | 470 | 3.2 | COMP. EX. |
| 11 | B | 1260 | 890 | 35 | 120 | 430 | 2.6 | EX. |
| 12 | C | 1260 | 890 | 35 | 120 | 430 | 2.6 | EX. |
| 13 | D | 1260 | 890 | 35 | 120 | 430 | 2.6 | EX. |
| 14 | E | 1260 | 890 | 35 | 120 | 430 | 2.6 | EX. |
| 15 | F | 1260 | 890 | 35 | 120 | 430 | 2.6 | EX. |
| 16 | G | 1260 | 890 | 35 | 120 | 430 | 2.6 | EX. |
| 17 | H | 1260 | 890 | 35 | 120 | 430 | 2.6 | EX. |
| 18 | H | 1260 | 920 | 35 | 120 | 430 | 2.6 | EX. |
| 19 | I | 1260 | 890 | 35 | 120 | 430 | 2.6 | EX. |
| 20 | J | 1260 | 890 | 35 | 120 | 430 | 2.6 | EX. |
| 21 | K | 1260 | 890 | 35 | 120 | 430 | 2.6 | EX. |
| 22 | L | 1260 | 890 | 35 | 120 | 430 | 2.6 | EX. |
| 23 | M | 1260 | 890 | 35 | 120 | 430 | 2.6 | EX. |
| 24 | N | 1260 | 890 | 35 | 120 | 430 | 2.6 | EX. |
| 25 | N | 1260 | 930 | 35 | 120 | 430 | 2.6 | EX. |
| 26 | O | 1260 | 890 | 35 | 120 | 430 | 2.6 | COMP. EX. |
| 27 | P | 1260 | 890 | 35 | 120 | 430 | 2.6 | COMP. EX. |
| 28 | Q | 1260 | 890 | 35 | 120 | 430 | 2.6 | COMP. EX. |
| 29 | R | 1260 | 890 | 55 | 120 | 400 | 2.6 | COMP. EX. |
| 30 | S | 1260 | 940 | 35 | 120 | 430 | 2.6 | EX. |
| 31 | T | 1260 | 950 | 35 | 120 | 430 | 2.6 | EX. |

*After completion of rolling to 530° C.

**530° C. to coiling temperature

TABLE 3

| | | | Microstructure | | | | | | | Stretch | | |
|---|---|---|---|---|---|---|---|---|---|---|---|---|
| | | | Bainite phase | | Second phase | | Tensile properties | | | flange- | | |
| | | | | Average | | Average | | | | ability | | |
| Steel Sheet No. | Steel No. | Dissolved Ti content (mass %) | Fraction (% by area) | Grain Diameter (μm) | Kind*: % by area | Grain Diameter (μm) | Yield strength YP (MPa) | Tensile strength TS (MPa) | Elonga-tion El (%) | Hole expanding ratio (%) | Fatigue resistance σf/TS | Remarks |
| 1 | A | 0.040 | 100 | 2.3 | — | — | 720 | 815 | 18 | 75 | 0.55 | EX. |
| 2 | A | 0.040 | 100 | 4.2 | — | — | 700 | 790 | 19 | 80 | 0.56 | EX. |
| 3 | A | 0.040 | 100 | 3.5 | — | — | 715 | 810 | 18 | 72 | 0.55 | EX. |
| 4 | A | 0.040 | 100 | 2.4 | — | — | 725 | 820 | 17 | 67 | 0.55 | EX. |
| 5 | A | 0.040 | 100 | 2.0 | — | — | 731 | 823 | 16 | 62 | 0.55 | EX. |
| 6 | A | 0.035 | 98 | 2.5 | α: 2 | 0.7 | 710 | 805 | 20 | 65 | 0.55 | EX. |
| 7 | A | 0.010 | 73 | 6.1 | P: 12, α: 15 | 4.0 | 645 | 760 | 16 | 40 | 0.45 | COMP. EX. |
| 8 | A | 0.050 | 85 | 2.1 | M: 15 | 1.5 | 772 | 910 | 15 | 24 | 0.44 | COMP. EX. |
| 9 | A | 0.030 | 88 | 5.6 | P: 6, α: 6 | 4.2 | 670 | 770 | 15 | 54 | 0.46 | COMP. EX. |
| 10 | A | 0.010 | 65 | 4.6 | P: 5, α: 30 | 5.2 | 606 | 730 | 16 | 40 | 0.44 | COMP. EX. |
| 11 | B | 0.055 | 100 | 2.2 | — | — | 750 | 820 | 18 | 90 | 0.58 | EX. |
| 12 | C | 0.045 | 100 | 1.9 | — | — | 740 | 840 | 17 | 67 | 0.55 | EX. |
| 13 | D | 0.030 | 100 | 2.7 | — | — | 705 | 782 | 18 | 80 | 0.55 | EX. |
| 14 | E | 0.040 | 100 | 2.3 | — | — | 752 | 835 | 17 | 90 | 0.55 | EX. |
| 15 | F | 0.055 | 100 | 2.2 | — | — | 760 | 846 | 16 | 70 | 0.56 | EX. |
| 16 | G | 0.040 | 96 | 1.9 | M: 4 | 0.5 | 780 | 870 | 15 | 80 | 0.55 | EX. |
| 17 | H | 0.070 | 93 | 2.4 | α: 2, M: 5 | 1.2 | 722 | 840 | 16 | 65 | 0.55 | EX. |
| 18 | H | 0.070 | 95 | 4.6 | M: 5 | 1.2 | 710 | 830 | 17 | 73 | 0.56 | EX. |
| 19 | I | 0.080 | 100 | 2.6 | — | — | 740 | 825 | 18 | 80 | 0.56 | EX. |
| 20 | J | 0.065 | 100 | 2.0 | — | — | 920 | 1020 | 13 | 85 | 0.59 | EX. |
| 21 | K | 0.045 | 100 | 1.8 | — | — | 945 | 1035 | 13 | 70 | 0.55 | EX. |
| 22 | L | 0.055 | 100 | 2.0 | — | — | 880 | 990 | 14 | 70 | 0.55 | EX. |
| 23 | M | 0.050 | 100 | 1.4 | — | — | 990 | 1105 | 12 | 65 | 0.55 | EX. |
| 24 | N | 0.050 | 100 | 1.8 | — | — | 970 | 1060 | 13 | 88 | 0.59 | EX. |
| 25 | N | 0.050 | 100 | 3.6 | — | — | 920 | 1000 | 14 | 92 | 0.60 | EX. |
| 26 | O | 0.005 | 30 | 5.7 | α: 70 | 8.4 | 520 | 580 | 14 | 34 | 0.45 | COMP. EX. |
| 27 | P | 0.034 | 85 | 2.4 | M: 15 | 1.7 | 720 | 830 | 14 | 20 | 0.45 | COMP. EX. |
| 28 | Q | 0.010 | 52 | 6.3 | α: 40, P: 8 | 5.1 | 580 | 790 | 10 | 37 | 0.43 | COMP. EX. |
| 29 | R | 0.007 | 92 | 3.0 | M: 8 | 1.7 | 880 | 1030 | 8 | 30 | 0.40 | COMP. EX. |
| 30 | S | 0.040 | 100 | 4.4 | — | — | 695 | 785 | 19 | 80 | 0.56 | EX. |
| 31 | T | 0.040 | 100 | 3.8 | — | — | 710 | 800 | 18 | 75 | 0.56 | EX. |

*P: pearlite, M: martensite, Rγ: retained austenite, α: ferrite

All of the high strength hot-rolled steel sheets in our EXAMPLES exhibited high strength with a tensile strength TS of not less than 780 MPa, excellent stretch flangeability with a hole expanding ratio λ of not less than 60%, and excellent fatigue resistance with σf/TS of not less than 0.55. In particular, it has been shown that stretch flangeability and fatigue resistance were further improved by increasing the hot rolling finishing temperature above 900° C. On the other hand, the COMPARATIVE EXAMPLES, which were outside our ranges, resulted in a tensile strength TS of less than 780 MPa, a hole expanding ratio λ of less than 60% or σf/TS of less than 0.55, and the hot-rolled steel sheets did not satisfy all of desired high strength, stretch flangeability and fatigue resistance.

The invention claimed is:

1. A method of manufacturing high strength hot-rolled steel sheets with excellent stretch flangeability and fatigue resistance comprising:

heating steel at 1150 to 1350° C. which has a composition comprising, in terms of mass %, C at 0.05 to 0.15%, Si at 0.2 to 1.2%, Mn at 1.0 to 2.0%, P at not more than 0.04%, S at not more than 0.005%, Ti at 0.05 to 0.15%, Al at 0.005 to 0.10% and N at 0.002 to 0.007%, wherein content of dissolved Ti is not less than 0.02%, the balance being represented by Fe and inevitable impurities, hot rolling the steel into a hot-rolled sheet which is terminated at a finishing temperature of 850 to 950° C., cooling the steel sheet to 530° C. at an average cooling rate of not less than 30° C./s and less than 55° C./s, cooling the steel sheet to a coiling temperature of 300 to 500° C. at an average cooling rate of not less than 100° C./s, and coiling the steel sheet at the coiling temperature such that the high-strength hot-rolled steel sheets comprise a bainite single phase microstructure having an average grain diameter of more than 3.0 to 5 μm.

2. The method according to claim 1, wherein the steel is heated to more than 1200° C. to not more than 1350° C. and thereafter hot rolled by hot rolling which is terminated at a finishing temperature of more than 900° C. to not more than 950° C.

3. The method according to claim 1, wherein the composition further comprises, in terms of mass %, Sb at 0.001 to 0.020%.

4. The method according to claim 1, wherein the composition further comprises, in terms of mass %, one, or two or more selected from Cu at 0.05 to 0.20%, Ni at 0.05 to 0.50%, Mo at 0.05 to 0.50%, Cr at 0.05 to 0.50%, B at 0.0005 to 0.0050%, Nb at 0.01 to 0.10% and V at 0.01 to 0.20%.

5. The method according to claim 1, wherein the composition further comprises, in terms of mass %, one or two selected from Ca at 0.0001 to 0.0050% and REM at 0.0005 to 0.0100%.

* * * * *

UNITED STATES PATENT AND TRADEMARK OFFICE

CERTIFICATE OF CORRECTION

PATENT NO. : 9,222,155 B2
APPLICATION NO. : 13/699028
DATED : December 29, 2015
INVENTOR(S) : Nakamura et al.

It is certified that error appears in the above-identified patent and that said Letters Patent is hereby corrected as shown below:

In column 12

At line 55, please change "of/TS" to -- σf/TS --.

Signed and Sealed this
Twenty-sixth Day of July, 2016

Michelle K. Lee

Michelle K. Lee
*Director of the United States Patent and Trademark Office*